US011294301B2

(12) United States Patent
Ahn et al.

(10) Patent No.: US 11,294,301 B2
(45) Date of Patent: Apr. 5, 2022

(54) DETECTING TONER INJECTION AMOUNT OF TONER REFILL CARTRIDGE

(71) Applicant: HEWLETT-PACKARD DEVELOPMENT COMPANY, L.P., Spring, TX (US)

(72) Inventors: Sungchul Ahn, Suwon-si (KR); Seongho Jeong, Suwon-si (KR); Byeongno Jeong, Suwon-si (KR); Woojin Kim, Suwon-si (KR)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/271,898

(22) PCT Filed: Dec. 5, 2019

(86) PCT No.: PCT/US2019/064633

§ 371 (c)(1),
(2) Date: Feb. 26, 2021

(87) PCT Pub. No.: WO2020/251618

PCT Pub. Date: Dec. 17, 2020

(65) Prior Publication Data

US 2021/0191290 A1 Jun. 24, 2021

(30) Foreign Application Priority Data

Jun. 14, 2019 (KR) ..... 10-2019-0071002

(51) Int. Cl.
*G03G 15/00* (2006.01)
*G03G 15/08* (2006.01)

(52) U.S. Cl.
CPC ..... *G03G 15/086* (2013.01); *G03G 15/0867* (2013.01); *G03G 15/0877* (2013.01); *G03G 15/80* (2013.01)

(58) Field of Classification Search
CPC ..... G03G 15/086; G03G 15/0867; G03G 15/0877; G03G 15/0894; G03G 15/5016; G03G 15/556; G03G 15/80
See application file for complete search history.

(56) References Cited

U.S. PATENT DOCUMENTS

| | | | |
|---|---|---|---|
| 6,572,224 | B2 | 6/2003 | Wakayama et al. |
| 7,325,385 | B2 | 2/2008 | Nagashima et al. |
| 7,344,213 | B2 | 3/2008 | Iwamoto et al. |
| 7,673,977 | B2 | 3/2010 | Terada |

(Continued)

FOREIGN PATENT DOCUMENTS

| | | |
|---|---|---|
| KR | 10-0365825 | 12/2002 |
| KR | 10-1332132 | 11/2013 |

*Primary Examiner* — Sophia S Chen
(74) *Attorney, Agent, or Firm* — Trop Pruner & Hu, P.C.

(57) ABSTRACT

An example toner refill cartridge includes a body to accommodate toner, a plunger inserted into the body and movably coupled to the body in a longitudinal direction of the body, and capable of pushing the toner out of the body, a toner injection amount detector to detect each of a plurality of movement positions of the plunger in accordance with the movement of the plunger, and a connection interface to connect to an image forming apparatus to transmit a signal corresponding to each of the detected movement position to the image forming apparatus.

15 Claims, 11 Drawing Sheets

(56) References Cited

U.S. PATENT DOCUMENTS

| | | | | |
|---|---|---|---|---|
| 7,873,304 | B2 | 1/2011 | Iwamoto et al. | |
| 2003/0038939 | A1* | 2/2003 | Franzen ..... | G03G 15/0855 356/425 |
| 2004/0134560 | A1 | 7/2004 | Sato et al. | |
| 2021/0232064 | A1* | 7/2021 | Cho ..... | G03G 15/0877 |

* cited by examiner

FIG. 8

| | ADC voltage | Reflected gauge |
|---|---|---|
| before injection | 0V | – |
| SW 1 OPEN | 0.37V | 60% |
| SW 1, 2 OPEN | 0.73V | 80% |
| SW 1, 2, 3 OPEN | 1.1V | 100% |

FIG. 10

| | toner gauge before filling | toner injection amount | toner gauge after filling |
|---|---|---|---|
| Case 1 | 10%(toner 13g) | 60%(toner 78g) | 70%(toner 91g) |
| Case 2 | 10%(toner 13g) | 80%(toner 104g) | 90%(toner 117g) |
| Case 3 | 0%(toner 0g) | 60%(toner 78g) | 60%(toner 78g) |
| Case 4 | 0%(toner 0g) | 80%(toner 104g) | 80%(toner 104g) |
| Case 5 | 0%(toner 0g) | 100%(toner 130g) | 100%(toner 130g) |

FIG. 11

| | | toner gauge of image forming apparatus 1 | toner gauge of image forming apparatus 2 | toner gauge after filling |
|---|---|---|---|---|
| Case 1 | before | 30%(toner 39g) | 40%(toner 52g) | fill image forming apparatus 1 with 60% of toner (78 g), and fill image forming apparatus 2 with 40% of toner (52 g) |
| | after | 90%(toner 117g) | 80%(toner 104g) | |
| Case 2 | before | 0%(toner 0g) | 50%(toner 65g) | fill image forming apparatus 1 with 80% of toner (104 g), and fill image forming apparatus 2 with 20% of toner (26 g) |
| | after | 80%(toner 104g) | 70%(toner 91g) | |

DETECTING TONER INJECTION AMOUNT OF TONER REFILL CARTRIDGE

BACKGROUND

An image forming apparatus such as a printer, a multifunctional apparatus, or the like may form a visible toner image by supplying toner accommodated in a developing cartridge to an electrostatic latent image formed on a photoconductor. When the toner accommodated in the developing cartridge is exhausted, the developing cartridge in which the toner is exhausted may be replaced with a new developing cartridge, or the developing cartridge may be refilled with toner.

BRIEF DESCRIPTION OF THE DRAWINGS

FIG. 8 illustrates a manner of detecting a signal corresponding to each of a plurality of movement positions of a plunger of a toner refill cartridge and confirming a degree of toner injection corresponding to a voltage level of the detected signal according to an example.

FIG. 10 illustrates a manner of determining a filling degree of toner by confirming a degree of toner injection by an image forming apparatus according to an example.

FIG. 11 illustrates a manner of determining a filling degree of toner in each image forming apparatus when a toner refill cartridge divides and injects toner into a plurality of image forming apparatuses according to an example.

DETAILED DESCRIPTION OF EXAMPLES

Figure 1:
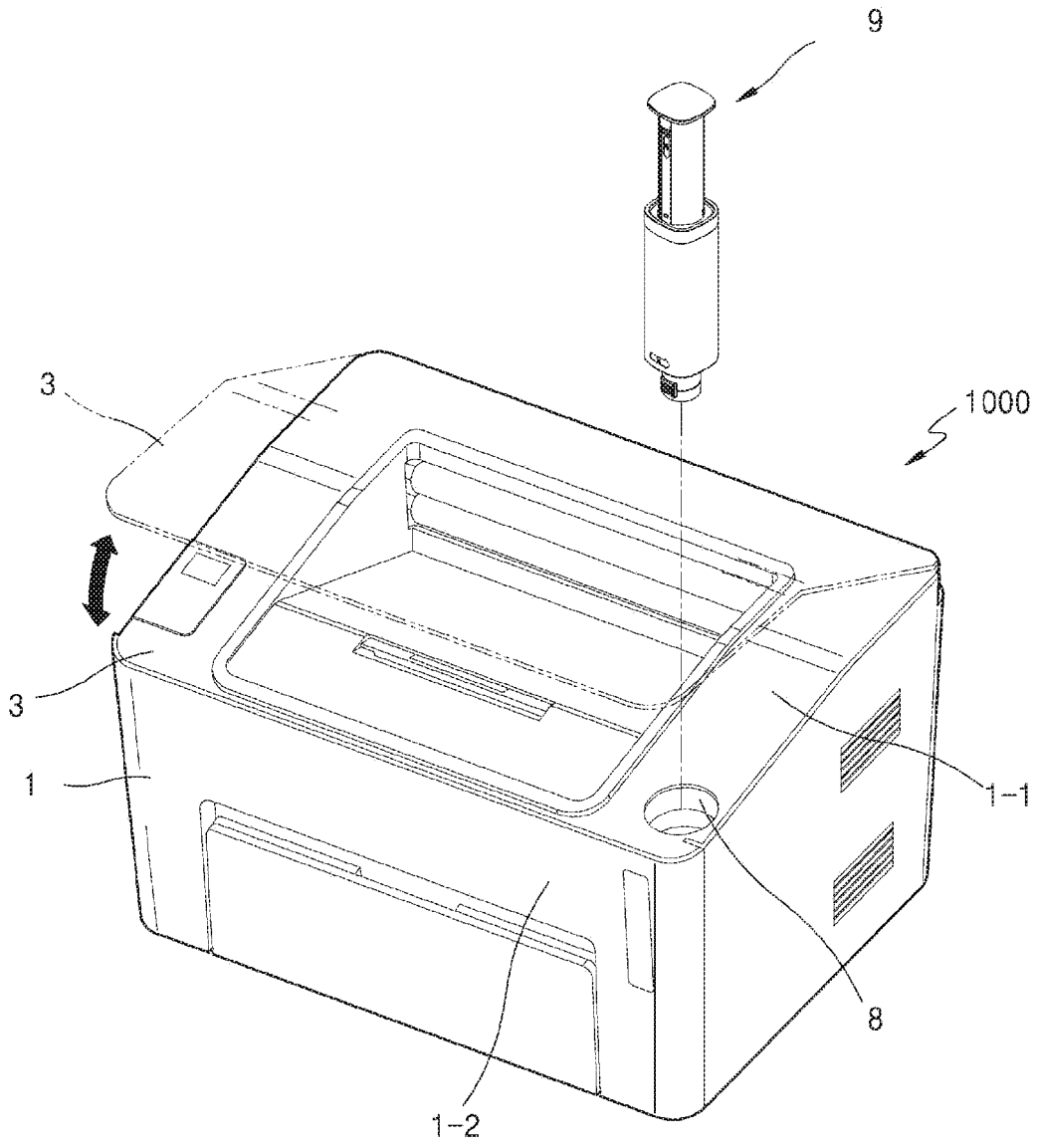
FIG. 1 illustrates an image forming apparatus connected to a toner refill cartridge for toner refilling according to an example.

Reference will now be made to examples that are illustrated in the accompanying drawings. The same reference numerals are used to denote the same elements, and repeated descriptions thereof will not be given herein.

Figure 2:
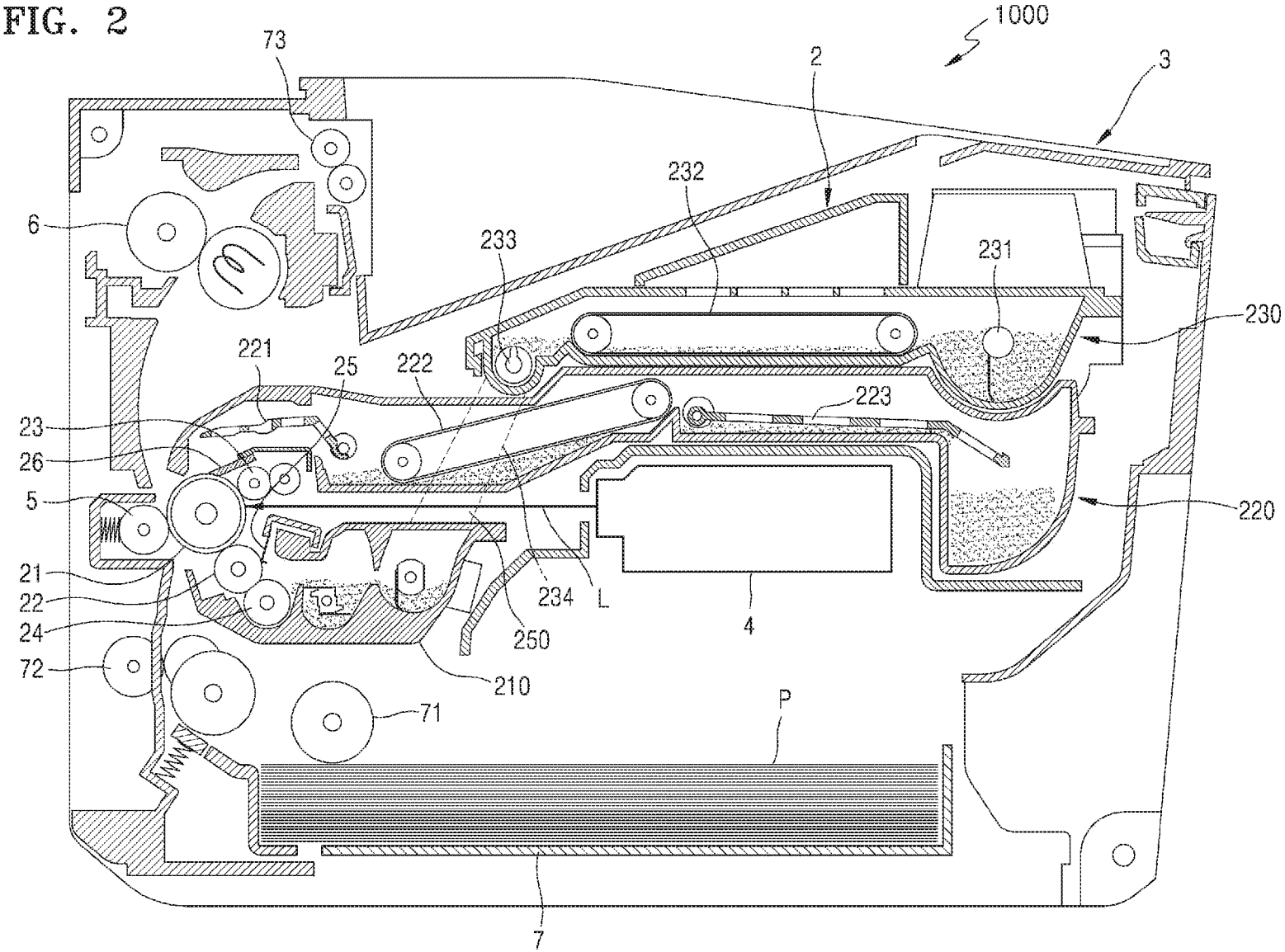
FIG. 2 illustrates an image forming apparatus according to an example.
Figure 3:
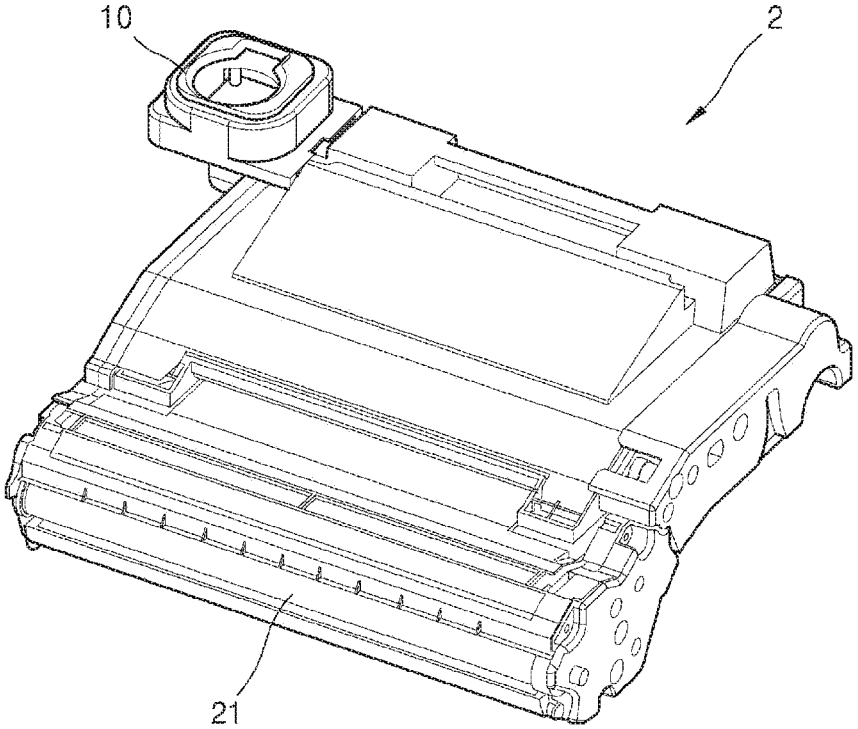
FIG. 3 illustrates a developing cartridge and a toner refilling portion connected to the developing cartridge according to an example.
Figure 4:
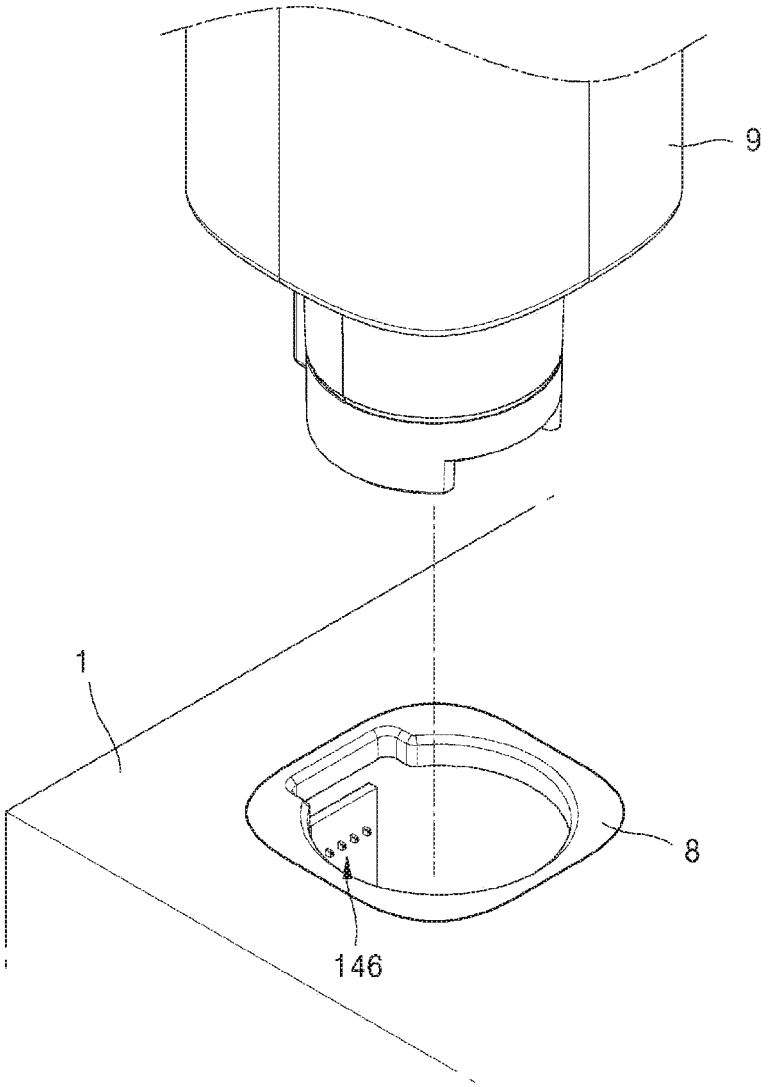
FIG. 4 illustrates a toner refill cartridge which accesses a toner refilling portion from the outside of a main body of an image forming apparatus through a communicating portion according to an example.

FIG. 1 illustrates an image forming apparatus connected to a toner refill cartridge for toner refilling according to an example. FIG. 2 illustrates an image forming apparatus according to an example. FIG. 3 illustrates a developing cartridge and a toner refilling portion connected to the developing cartridge according to an example. FIG. 4 illustrates a toner refill cartridge which accesses a toner refilling portion from the outside of a main body of an image forming apparatus through a communicating portion according to an example.

An image forming apparatus may perform an image forming job, such as printing, copying, scanning, or faxing. An image forming apparatus may form an image on a print medium such as printing paper by various printing methods such as an electrophotographic method, an inkjet method, a thermal transfer method, a thermal sensitive method, and the like.

Referring to FIGS. 1 to 4, an image forming apparatus 1000 may include a main body 1 and a developing cartridge 2 in the form of a cartridge removable from the main body 1. The main body 1 may include a door 3. The door 3 may open and close a portion of the main body 1. The main body 1 may include a communicating portion 8 to provide access to a toner refilling portion 10 of the developing cartridge 2 from outside the main body 1 in a state in which the developing cartridge 2 is mounted on the main body 1. The communicating portion 8 may be provided at a position close to a front surface 1-2 of the main body 1. The communicating portion 8 may be provided on an upper surface 1-1 of the main body 1. The toner refilling portion 10 may be provided under the communicating portion 8. The communicating portion 8 and the toner refilling portion 10 may be aligned in a vertical direction. The toner refill cartridge 9 may access the toner refilling portion 10 from above the main body 1 through the communicating portion 8.

A photosensitive drum 21 may include a cylindrical metal pipe having a photosensitive layer with photoconductivity formed on a periphery thereof, as an example of a photoconductor on which an electrostatic latent image is provided. A charging roller 23 is an example of a charger to charge a surface of the photosensitive drum 21 to a uniform electric potential. A charging bias voltage may be applied to the charging roller 23. A developing roller 22 may supply toner to an electrostatic latent image formed on the surface of the photosensitive drum 21 to develop the electrostatic latent image.

A supply roller 24 may attach the toner to the developing roller 22. A supply bias voltage may be applied to the supply roller 24 to adhere toner to the developing roller 22. A regulating member 25 may regulate the amount of toner adhering to the surface of the developing roller 22. The regulating member 25 may be, for example, a regulating blade whose tip is brought into contact with the developing roller 22 at a certain pressure. A cleaning member 26 may remove residual toner and foreign materials from the surface of the photosensitive drum 21 before charging. The cleaning member 26 may be, for example, a cleaning blade whose tip is in contact with the surface of the photosensitive drum 21. Hereinafter, the foreign materials removed from the surface of the photosensitive drum 21 are referred to as waste toner.

An optical scanner 4 may scan the surface of the photosensitive drum 21 charged to a uniform potential with light modulated according to image information. The optical scanner 4 may be, for example, a laser scanning unit (LSU).

A transfer roller 5 is an example of a transfer unit which is located opposite the photosensitive drum 21 to form a transfer nip. A transfer bias voltage for transferring a toner image developed on the surface of the photosensitive drum 21 to a print medium P may be applied to the transfer roller 5.

The toner image transferred to the surface of the print medium P by the transfer roller 5 may be maintained on a surface of the print medium P by electrostatic attraction. A fixing device 6 may form a permanent print image on the print medium P by fixing the toner image on the print medium P by applying heat and pressure.

The developing cartridge 2 according to an example may include a developing portion 210 provided with the photosensitive drum 21 and the developing roller 22, a waste toner accommodating portion 220 in which waste toner removed from the photosensitive drum 21 is accommodated, and a toner accommodating portion 230 connected to the developing portion 210 to accommodate toner. In order to refill toner in the toner accommodating portion 230, the developing cartridge 2 may include the toner refilling portion 10 connected to the toner accommodating portion 230. The toner refilling portion 10 provides an interface between the toner refill cartridge 9 and the developing cartridge 2, which will be described below. The developing cartridge 2 may be an integrated developing cartridge including the developing portion 210, the waste toner accommodating portion 220, the toner accommodating portion 230, and the toner refilling portion 10.

A portion of an outer periphery of the photosensitive drum 21 may be exposed to an outside of the housing. The transfer roller 5 may contact the exposed portion of the photosensitive drum 21 to form the transfer nip. The developing portion 210 may include one or more carrying members for carrying toner toward the developing roller 22. The carrying member may also stir toner to charge the toner to a certain potential.

The waste toner accommodating portion 220 may be located above the developing portion 210. The waste toner accommodating portion 220 may be spaced upward from the developing portion 210 to form an optical path 250 therebetween. Waste toner removed from the surface of the photosensitive drum 21 by the cleaning member 26 may be accommodated in the waste toner accommodating portion 220. The waste toner removed from the surface of the photosensitive drum 21 may be transferred to the inside of the waste toner accommodating portion 220 by one or more transfer members 221, 222, and 223.

The toner accommodating portion 230 may be connected to the toner refilling portion 10 to accommodate toner. The toner accommodating portion 230 may be connected to the developing portion 210 by a toner supply 234 as shown by dashed lines in FIG. 2. As shown in FIG. 2, the toner supply 234 may be connected to the developing portion 210 through the waste toner accommodating portion 220 in the vertical direction. The toner supply 234 may be located outside an effective width of exposure light L so as not to interfere with the exposure light L scanned in a main scanning direction by the optical scanner 4.

The toner accommodating portion 230 may include one or more toner supply members 231, 232, and 233 for supplying toner to the developing portion 210 through the toner supply 234.

An example of an image forming process according to the above-described configuration will be briefly described. A charging bias voltage is applied to the charging roller 23, and the photosensitive drum 21 may be charged to a uniform potential. The optical scanner 4 may scan the photosensitive drum 21 with light modulated corresponding to image information to form an electrostatic latent image on the surface of the photosensitive drum 21. The supply roller 24 may attach toner to the surface of the developing roller 22. The regulating member 25 may form a toner layer having a uniform thickness on the surface of the developing roller 22. A developing bias voltage may be applied to the developing roller 22. Toner carried to the developing nip as the developing roller 22 is rotated is moved and attached to the electrostatic latent image formed on the surface of the photosensitive drum 21 by a developing bias voltage so that a visible toner image may be formed on the surface of the photosensitive drum 21. The print medium P drawn out from a loading unit 7 by a pickup roller 71 may be transferred to the transfer nip where the transfer roller 5 and the photosensitive drum 21 face each other by a feed roller 72. When a transfer bias voltage is applied to the transfer roller 5, the toner image may be transferred to the print medium P by electrostatic attraction. The toner image transferred to the print medium P is fixed to the print medium P by receiving heat and pressure from the fixing device 6, whereby printing may be completed. The print medium P is discharged by a discharge roller 73.

FIG. 4 shows a state in which the toner refill cartridge 9 accesses the communicating portion 8. When the toner refill cartridge 9 is inserted into the communicating portion 8 from above the main body 1, the toner refill cartridge 9 may be mounted on the toner refilling portion 10. When pressure is applied to an upper portion of the toner refill cartridge 9 in a state where the toner refill cartridge 9 is mounted on the toner refilling portion 10, toner accommodated in a body of the toner refill cartridge 9 may be discharged to the outside of the body and the discharged toner may be supplied to the toner accommodating portion 230 of the developing cartridge 2 through the toner refilling portion 10. The toner refill cartridge 9 may be removed from the communicating portion 8 after toner injection.

Figure 5:
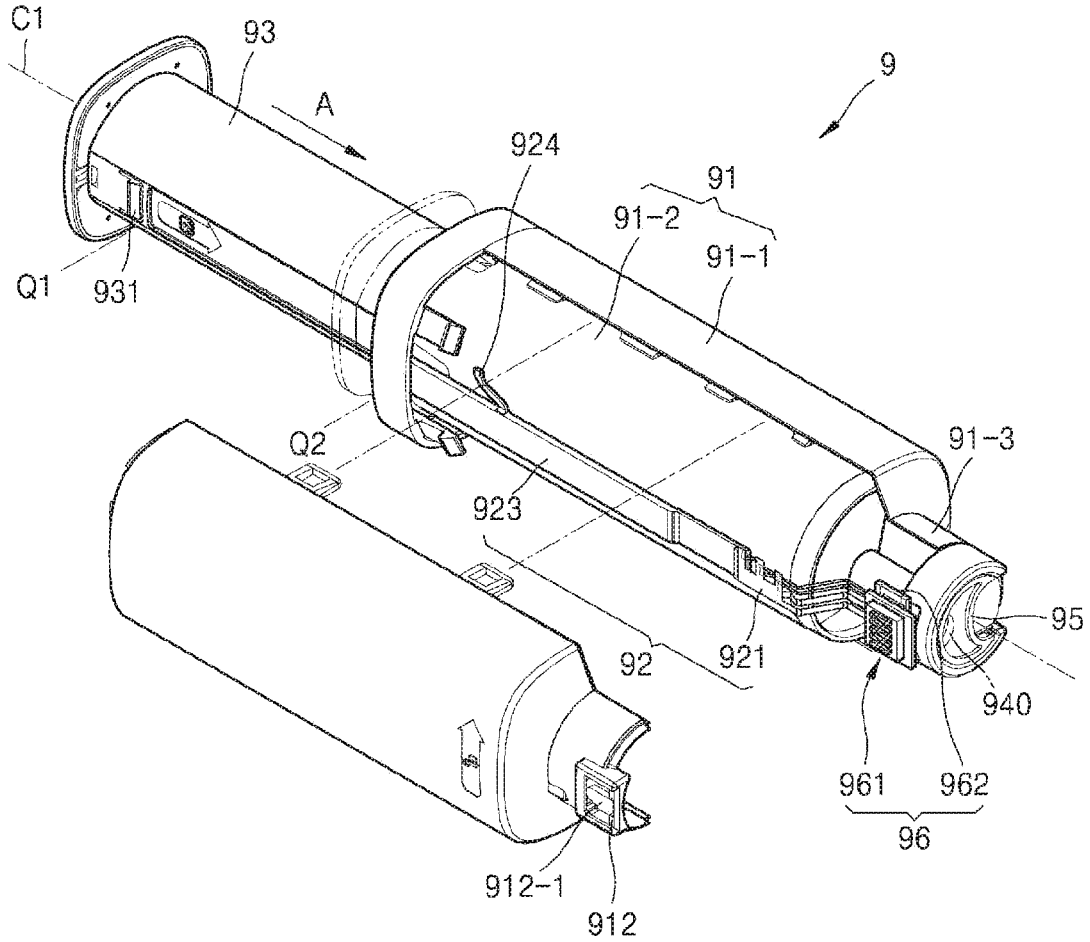
FIG. 5 illustrates a toner refill cartridge according to an example.

FIG. 5 illustrates a toner refill cartridge according to an example.

Referring to FIG. 5, the toner refill cartridge 9 may be a syringe toner refill cartridge including a body 91 to accommodate toner and having a toner discharge portion 940, and a plunger 93 which is movably coupled to the body 91 in a longitudinal direction A to push toner out of the body 91. The toner discharge portion 940 may be provided at a tip portion 91-3 of the body 91. A discharge shutter 95 may selectively open and close the toner discharge portion 940. A protruding portion 912 partially protruding outwardly may be provided at the tip portion 91-3 of the body 91.

The body 91 may include an outer body 91-1 and an inner body 91-2 located inside the outer body 91-1 to accommodate toner. The toner discharge portion 940 may be provided in the inner body 91-2. The plunger 93 may be inserted into the inner body 91-2 and movably coupled to the body 91 in the longitudinal direction A to push toner out of the body 91. The plunger 93 may be moved between a first position Q1 and a second position Q2. The discharge shutter 95 may be provided so as to be independently rotatable with respect to the tip portion 91-3 of the body 91. For example, as shown in FIG. 5, the discharge shutter 95 may be located in a closed position that blocks the toner discharge portion 940. Further, the discharge shutter 95 may be located at a discharge position where the discharge shutter 95 is rotated 180 degrees with respect to the body 91 to open the toner discharge portion 940. The discharge shutter 95 may be rotated with respect to a first rotation axis C1. The first rotation axis C1 may be, for example, a central axis of the cylindrical tip portion 91-3.

The toner refill cartridge 9 may be provided with a toner injection amount detector 92 for detecting each of a plurality of movement positions of the plunger 93 in accordance with the movement of the plunger 93. A signal corresponding to the detected movement position of the plunger 93 may indicate the degree of toner injection. Referring to FIG. 5, the toner injection amount detector 92 may include a plurality of switches 921 provided between the outer body 91-1 and the inner body 91-2. The plurality of switches 921 may be connected to a connection interface 96. An electrical contact state of the plurality of switches 921 may vary depending on the movement position of the plunger 93. The electrical contact state of each of the plurality of switches 921 may change from a first state to a second state depending on the movement position of the plunger 93. For example, the first state and the second state may be an electrical open state and an electrical short state, respectively, or vice versa. A movable member 923 movable in the longitudinal direction A may be provided between the outer body 91-1 and the inner body 91-2 in order to change the electrical contact state of the plurality of switches 921. The movable member 923 may move only in a direction in which the plunger 93 pushes the toner out of the body 91. The plunger 93 may be provided with a pushing protrusion 931 so as to be able to open and close each of the plurality of switches 921 by pushing the movable member 923 from when the plunger 93 reaches a certain position.

The toner injection amount detector 92 may include the plurality of switches 921 connected to the connection interface 96 and the movable member 96 that moves in the longitudinal direction of the body by the plunger 93 to change the electrical contact state of the plurality of switches 921. A hooking member 924 provided on the movable member 923 may be locked and fixed to a protruding portion formed on the body 91 until the plunger 93 reaches a certain position.

For example, the plurality of switches 921 may be kept closed before the toner refill cartridge 9 performs toner injection. When the plunger 93 moves in the longitudinal direction A and reaches a certain position, the movable member 923 may move. The movable member 923 is pushed by the pushing protrusion 931 provided on the plunger 93 from the time when the plunger 93 reaches the certain position and may sequentially open the plurality of closed switches 921 on a moving path of the movable member 923.

As another example, the plurality of switches 921 may be kept open before the toner refill cartridge 9 performs toner injection. When the plunger 93 moves in the longitudinal direction A and reaches a certain position, the movable member 923 may move. The movable member 923 is pushed by the pushing protrusion 931 provided on the plunger 93 from the time when the plunger 93 reaches the certain position and may sequentially close the plurality of open switches 921 on the moving path of the movable member 923.

The connection interface 96 may be provided at the tip portion 91-3 of the body 91. When the toner refill cartridge 9 is mounted on the toner refilling portion 10, the connection interface 96 may be electrically connected to the main body 1 to transmit information of the toner refill cartridge 9 to the main body 1. For example, the connection interface 96 may be connected to the image forming apparatus 1000 and may transmit a signal corresponding to a detected movement position of the plunger 93 to the image forming apparatus 1000. The connection interface 96 may be electrically connected to a first connector 146 provided in the toner refilling portion 10.

The connection interface 96 may include an information manager 962 for managing information related to the toner refill cartridge 9 and an electrical contact portion 961 for connection with the main body 1. The information manager 962 may be a customer replaceable unit monitor (CRUM) including a processor for performing at least one of authentication and/or encrypted data communication with the main body 1. The information manager 962 may further include a memory (not shown). The memory may store various types of information for the toner refill cartridge 9. For example, information about a manufacturer, a manufacturing date and time, unique information such as a serial number, a model name, and the like, various programs, digital signature information, a usage state (e.g., how many sheets have been printed so far, how many remaining sheets can be printed, and how much toner is remaining), etc. may be stored in the memory. In addition, information about a lifetime of the toner refill cartridge 9, a setup menu, and the like may be stored in the memory. In addition, the information manager 962 may include functional blocks capable of performing various functions for communication authentication, encryption, and the like with the main body 1. The information manager 962 may be implemented in the form of a chip including a processor and/or a memory, or a printed circuit board assembly (PBA) in which circuit elements for implementing chips and various functional blocks are mounted.

When the toner refill cartridge 9 is mounted on the toner refilling portion 10 of the image forming apparatus 1000, the connection interface 96 of the toner refill cartridge 9 may be electrically connected to the first connector 146 located at a certain portion of the toner refilling portion 10. The electrical contact portion 961 may be provided on a front surface of the connection interface 96 and the information manager 962 including a memory for storing information related to the toner refill cartridge 9 may be implemented on a rear surface of the connection interface 96. A plurality of electrical contacts provided in the first connector 146 may correspond to the electrical contact portion 961 of the connection interface 96. A configuration of the electrical contact portion 961 may vary depending on an operating method of the toner injection amount detector 92. The electrical contact portion 961 may be exposed to the outside of the body 91 through an opening 912-1 provided in the protruding portion 912.

Figure 6A:
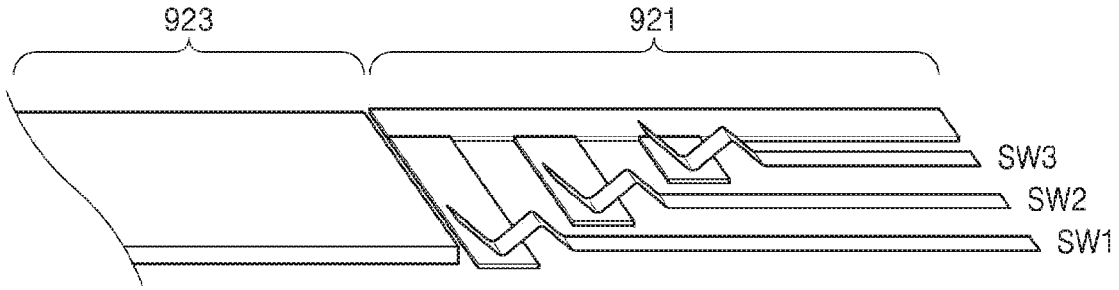
FIGS. 6A, 6B, and 6C illustrate a structure and an operating method of a plurality of switches and a movable member constituting a toner injection amount detector according to an example.
Figure 6B:
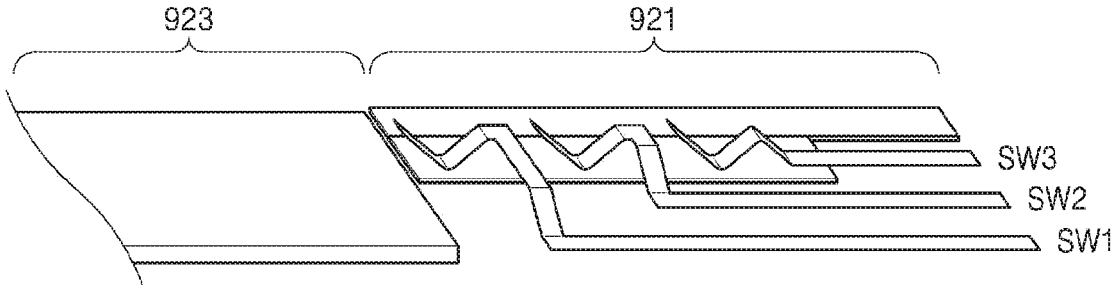
Figure 6C:
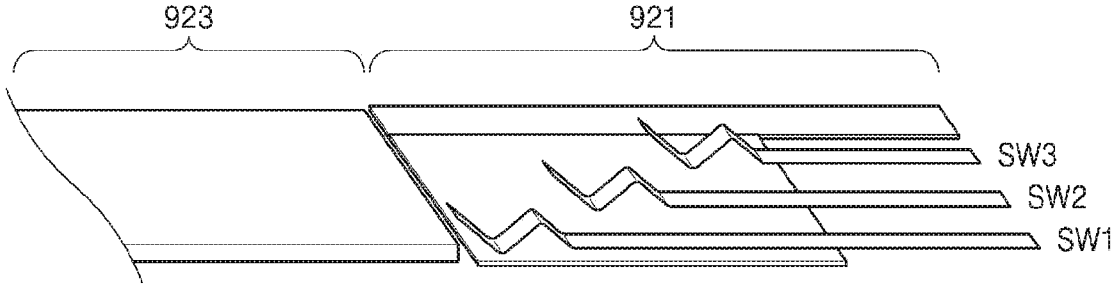

FIGS. 6A, 6B, and 6C illustrate a structure and an operating method of a plurality of switches and a movable member constituting a toner injection amount detector according to an example.

Referring to FIGS. 6A, 6B, and 6C, the plurality of switches 921 may be implemented in various structures and forms, but are not limited thereto.

Each of FIGS. 6A, 6B, and 6C shows the plurality of switches 921 including three switches SW1, SW2, and SW3, but the disclosure is not limited thereto. The number of the plurality of switches 921 may vary depending on how precisely the toner injection amount is detected. An electrical contact state of the switches 921 shown in each of FIGS. 6A, 6B, and 6C may be changed as the movable member 923 moves in a longitudinal direction of the body 91 by the plunger 93. In each of FIGS. 6A, 6B, and 6C, as the movable member 923 moves toward the plurality of switches 921, interference first occurs with the switch SW1, then with the switch SW2, and finally with the switch SW3. Thus, the electrical contact state of each of the switches 921 may be changed.

Each of FIGS. 6A, 6B, and 6C shows a structure and an operating mode of the movable member 923 which sequentially opens the plurality of closed switches 921 on the moving path of the movable member 923. However, the movable member 923 may sequentially close the plurality of open switches 921 on the moving path of the movable member 923.

In each of FIGS. 6A, 6B, and 6C, points where the plurality of switches 921 are opened and closed may be equally spaced in the longitudinal direction of the body 91 on the moving path of the movable member 923.

Figure 7:
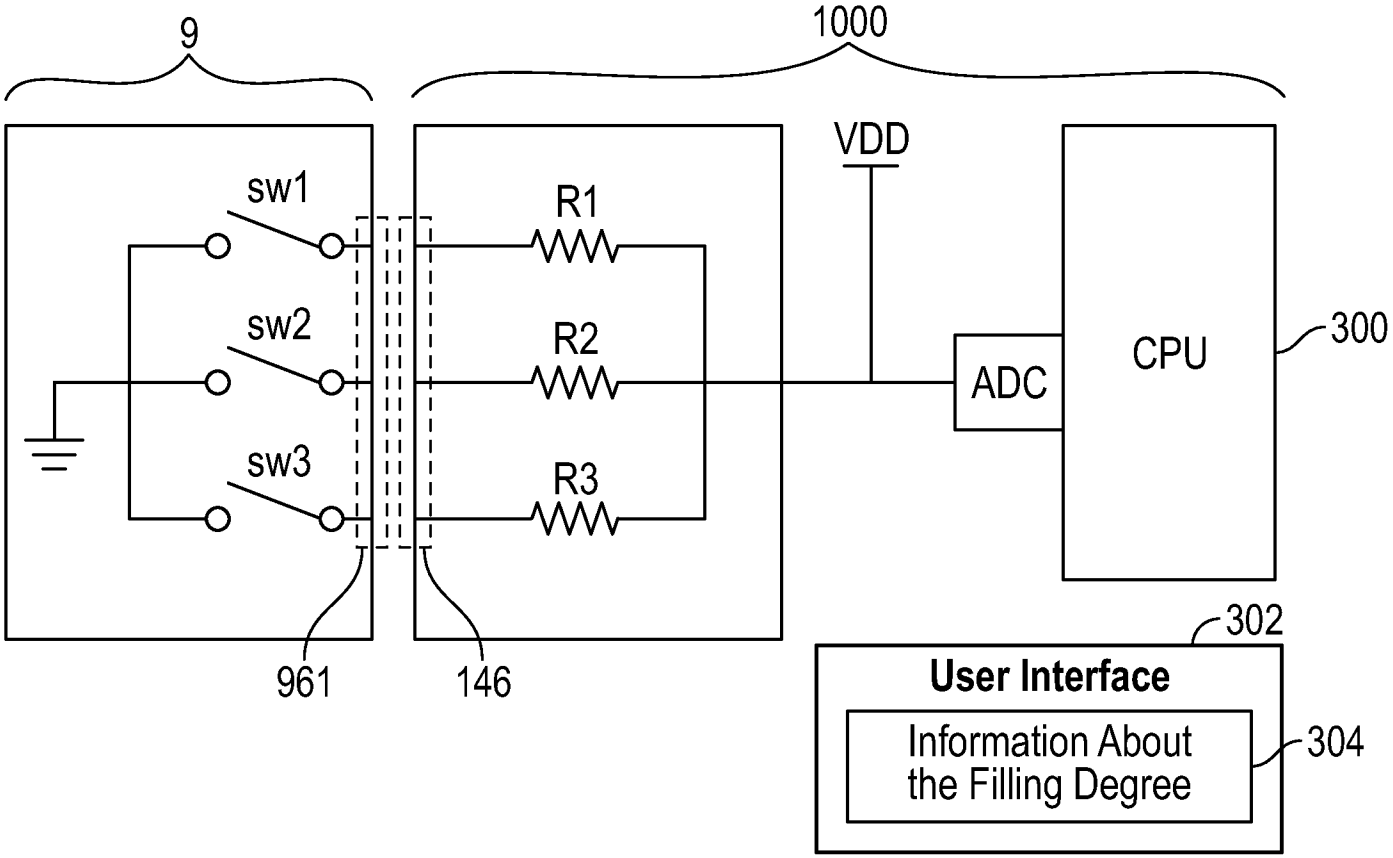
FIG. 7 illustrates a manner in which an image forming apparatus confirms a degree of toner injection in accordance with a change in an electrical contact state of a plurality of switches constituting a toner injection amount detector in a toner refill cartridge according to an example.

FIG. 7 illustrates a manner in which an image forming apparatus confirms a degree of toner injection in accordance with a change in an electrical contact state of a plurality of switches constituting a toner injection amount detector in a toner refill cartridge according to an example.

Referring to FIG. 7, the image forming apparatus 1000, on which the toner refill cartridge 9 is mounted, may include the main body 1, the developing cartridge 2, the toner refilling portion 10, and a processor 300. In the state in which the toner refill cartridge 9 is mounted on the image forming apparatus 1000, the electrical contact portion 961 of the toner refill cartridge 9 may contact the first connector 146 provided in the toner refilling portion 10.

The developing cartridge 2 supplies toner accommodated in the toner accommodating portion 230 to an electrostatic latent image formed on a photoconductor to form a toner image, the developing cartridge 2 being removable from the main body 1. The toner refilling portion 10 may be connected to the toner accommodating portion 230 and the toner refill cartridge 9 for refilling toner may be mounted on the toner accommodating portion 230.

The processor 300 may detect a signal corresponding to each of a plurality of movement positions of the plunger 93, detected in accordance with the movement of the plunger 93 of the toner refill cartridge 9 mounted on the toner refilling portion 10 and may determine the filling degree of toner based on the detected signal. The processor 300 may determine the filling degree of toner based on a voltage level of the detected signal. For this purpose, the processor 300 may previously store each of a plurality of voltage levels and a corresponding degree of toner injection, and may determine the filling degree of toner by confirming the degree of toner injection matched to the voltage level of the detected signal.

A user interface device 302 may output information 304 about the filling degree of toner determined by the processor 300. For example, the user interface device may be an indicator (e.g., a gauge) corresponding to the filling degree of toner, or a display device displaying information about the filling degree of toner.

As illustrated in FIG. 7, resistors R1, R2, and R3 respectively connected to the switches SW1, SW2, and SW3 constituting the toner injection amount detector 92 of the toner refill cartridge 9 are connected in parallel to each other. The processor 300 of the image forming apparatus 1000 may confirm the degree of toner injection from the toner refill cartridge 9 because a resistance value of R1, R2, and R3 connected in parallel to each other between VDD and ground is changed depending on the change in an electrical contact state of the switches SW1, SW2, and SW3 constituting the toner injection amount detector 92 of the toner refill cartridge 9. For example, before toner refill from the toner refill cartridge 9, the three switches SW1, SW2, and SW3 are closed and the voltage received by an analog digital converter (ADC) is OV. When toner refill is started from the toner refill cartridge 9, voltage values received by the ADC may vary as the switches are sequentially opened one by one beginning with the switch SW1. The processor 300 may confirm the degree of toner injection according to the value obtained through the ADC.

FIG. 8 illustrates a manner of detecting a signal corresponding to each of a plurality of movement positions of a plunger of a toner refill cartridge and confirming a degree of toner injection corresponding to a voltage level of the detected signal according to an example.

In the example of FIG. 8, all of the three switches SW1, SW2, and SW3 are closed before the toner refill from the toner refill cartridge 9. When the toner refill is started from the toner refill cartridge 9, voltage values are received by the ADC and the degrees of toner injection are confirmed by the processor 300 as the switches are sequentially opened beginning with the switch SW1.

Referring to FIG. 8, when all of the three switches SW1, SW2, and SW3 are closed, 0 V is detected in the ADC. When only switch SW1 is opened, 0.37 V is detected in the ADC. When switches SW1 and SW2 are opened, 0.73 V is detected in the ADC. When all of the three switches SW1, SW2, and SW3 are opened, 1.1 V is detected in the ADC. Since a controller 300 of the image forming apparatus 1000 previously stores each of a plurality of voltage levels and a corresponding degree of toner injection, the degree of toner injection corresponding to the voltage level detected by the ADC may be confirmed. As shown in FIG. 8, when the voltage is 0.37 V, 60% of the toner is refilled, when the voltage is 0.73 V, 80% of the toner is refilled, and when the voltage is 1.1 V, 100% of the toner is refilled from the toner refill cartridge 9.

In an example, all of the three switches SW1, SW2, and SW3 are opened before the toner refill from the toner refill cartridge 9. When the toner refill is started from the toner refill cartridge 9 and the switches are sequentially closed beginning with the switch SW1, when SW1, SW2, and SW3 are all open, 1.1 V is detected in the ADC, when only SW1 is closed, 0.37 V is detected in the ADC, when SW1 and SW2 are closed, 0.73 V is detected in the ADC, and when SW1, SW2, and SW3 are all closed, 0 V is detected in the ADC. The controller 300 of the image forming apparatus 1000 may confirm the degree of toner injection corresponding to the voltage level detected by the ADC.

Figure 9:
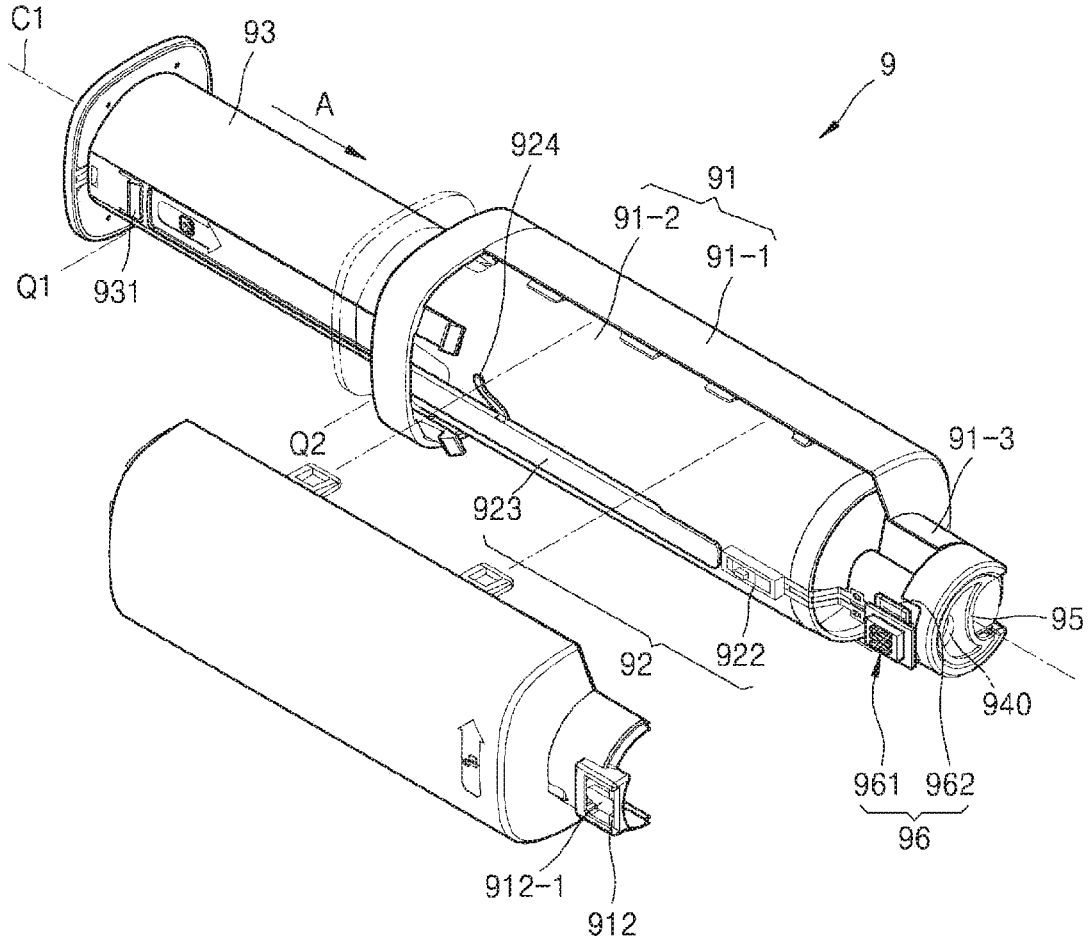
FIG. 9 illustrates a toner refill cartridge according to an example.

FIG. 9 illustrates a toner refill cartridge according to an example.

In FIG. 9, a description of the same constitution as that described with reference to FIG. 5 will not be given herein.

Referring to FIG. 9, the toner injection amount detector 92 may include a variable resistance switch 922 provided between the outer body 91-1 and the inner body 91-2. The variable resistance switch 922 may be connected to the connection interface 96. A resistance value of the variable resistance switch 922 may vary depending on the movement position of the plunger 93. The resistance value of the variable resistance switch 922 may gradually increase or decrease depending on the movement position of the plunger 93. The movable member 923 movable in the longitudinal direction A may be provided between the outer body 91-1 and the inner body 91-2 in order to change the resistance value of the variable resistance switch 922. The movable member 923 may move only in a direction in which the plunger 93 pushes the toner out of the body 91. The plunger 93 may be provided with the pushing protrusion 931 so as to be able to change the resistance value of the variable resistance switch 922 by pushing the movable member 923 from when the plunger 93 reaches a certain position.

The toner injection amount detector 92 may include the variable resistance switch 922 connected to the connection interface 96 and the movable member 923 that moves in the longitudinal direction A of the body by the plunger 93 to change the resistance value of the variable resistance switch 922. The hooking member 924 provided on the movable member 923 may be locked and fixed to a protruding portion (not shown) formed on the body 91 until the plunger 93 reaches a certain position.

For example, when the plunger 93 moves in the longitudinal direction A and reaches a certain position, the movable member 923 is pushed by the pushing protrusion 931 provided on the plunger 93 from the time when the plunger 93 reaches the certain position to push a protrusion formed on the variable resistance switch 922 on the moving path of the movable member 923 gradually so that the resistance value of the variable resistance switch 922 may be changed.

FIG. 10 illustrates a manner of determining a filling degree of toner by confirming a degree of toner injection by an image forming apparatus according to an example.

When toner is refilled from the toner refill cartridge 9, the image forming apparatus 1000 receives information indicating the degree of toner injection corresponding to the current movement position of the plunger 93 from the toner refill cartridge 9 to confirm a toner injection amount, and may determine the filling degree of toner after charging by combining the amount of toner before charging and the toner injection amount.

Referring to FIG. 10, in Case 1, a gauge may indicate that the amount of toner before charging is 10%, and when a toner injection amount by the toner refill cartridge 9 is 60%, the image forming apparatus 1000 may determine that there is a toner amount of 70% after charging. In the same way, in Case 2 to Case 5 it can be confirmed that the amount of toner before charging in the image forming apparatus 1000 and the toner injection amount by the toner refill cartridge 9 are combined to determine the amount of toner after charging in the image forming apparatus 1000.

FIG. 11 illustrates a manner of determining a filling degree of toner in each image forming apparatus when a toner refill cartridge divides and injects toner into a plurality of image forming apparatuses according to an example.

Referring to FIG. 11, when the toner refill cartridge 9 divides and injects toner into a plurality of image forming apparatuses, before the toner is injected in each of the image forming apparatuses 1000, the toner refill cartridge 9 may transmit information indicating the degree of toner injection from the toner refill cartridge 9 to the image forming apparatus 1000.

For example, when 60% of the toner accommodated in the toner refill cartridge 9 is completely injected in the first image forming apparatus 1000, even if the position of the plunger 93 of the same toner refill cartridge 9 connected to the second image forming apparatus 1000 indicates that 60% of the toner has been injected into the second image forming apparatus 1000, it should be noted that there is no actual toner injection in the second image forming apparatus 1000.

For this purpose, the information manager 962 of the toner refill cartridge 9 may store information indicating the degree of toner injection corresponding to the current movement position of the plunger 93 when the toner refill cartridge 9 is disconnected from the first image forming apparatus 1000. The information manager 962 of the toner refill cartridge 9 may transmit information indicating the degree of toner injection corresponding to the current movement position of the plunger 93 stored in the toner refill cartridge 9 to the second image forming apparatus 1000 when the toner refill cartridge 9 is connected to the second image forming apparatus 1000 other than the first image forming apparatus 1000. The processor 300 of the second image forming apparatus 1000 may receive information indicating the degree of toner injection corresponding to the current movement position of the plunger 93 from the toner refill cartridge 9 when the toner refill cartridge 9 is connected to the second image forming apparatus 1000.

As illustrated in FIG. 11, when a toner gauge of an image forming apparatus 1000 indicates an amount of toner is 30% and then 90% after toner refill in Case 1, it can be seen that the degree of toner injection corresponding to the current position of the plunger 93 is 60% because the toner refill cartridge 9 injects 60% of the toner into the image forming apparatus 1000. Thereafter, when the toner refill cartridge 9 is connected to an image forming apparatus 1000 and completes the toner refill, the image forming apparatus 1000 recognizes that the toner refill cartridge 9 has already injected 60% of the toner at the time when the toner refill cartridge 9 is connected to the image forming apparatus 1000. Therefore, even if the toner refill cartridge 9 refills all the toner of the toner refill cartridge 9 in the image forming apparatus 1000, it should be understood that only 40% of the toner is actually injected. To this end, when the toner refill cartridge 9 is connected to the image forming apparatus 1000, the toner refill cartridge 9 may transmit to the image forming apparatus 1000 information indicating that 60% of the toner corresponding to the current movement position of the plunger 93 stored in the toner refill cartridge 9 has been injected. When the image forming apparatus 1000 is connected to the toner refill cartridge 9, the image forming apparatus 1000 receives from the toner refill cartridge 9 information indicating that 60% of the toner corresponding to the current movement position of the plunger 93 has been injected. When the toner refill cartridge 9 has completed 100% toner injection, the image forming apparatus 1000 may confirm the toner injection amount of 40% and determine the filling degree of toner of 80% in total by combining the amount of toner of 40% remaining in the image forming apparatus 1000 before the toner refill and the toner injection amount of 40%.

Likewise, in Case 2, when the toner refill cartridge 9 is connected to the image forming apparatus 1000, the toner refill cartridge 9 may transmit to the image forming apparatus 1000 information indicating that 80% of the toner corresponding to the current movement position of the plunger 93 stored in the toner refill cartridge 9 has been injected. When the image forming apparatus 1000 is connected to the toner refill cartridge 9, the image forming apparatus 1000 receives from the toner refill cartridge 9 information indicating that 80% of the toner corresponding to the current movement position of the plunger 93 has been injected. When the toner refill cartridge 9 has completed 100% toner injection, the image forming apparatus 1000 may confirm the toner injection amount of 20% and determine the filling degree of toner of 70% in total by combining the amount of toner of 50% remaining in the image forming apparatus 1000 before the toner refill and the toner injection amount of 20%. It should be understood that while the above examples were made in terms of percentages of toner injection, information as to an amount (e.g., a weight, a volume, etc.) of toner injection may also be used.

It should be understood that examples described herein should be considered in a descriptive sense only and not for purposes of limitation. Descriptions of features or aspects within each example should typically be considered as available for other similar features or aspects in other examples. While one or more examples have been described with reference to the figures, it will be understood by those of ordinary skill in the art that various changes in form and details may be made therein without departing from the spirit and scope as defined by the following claims.

What is claimed is:

1. A toner refill cartridge comprising:

a body to accommodate toner;

a plunger inserted into the body and movably coupled to the body in a longitudinal direction of the body, and capable of pushing the toner out of the body;

a toner injection amount detector to detect each of a plurality of movement positions of the plunger in accordance with a movement of the plunger; and a connection interface to connect to an image forming apparatus to transmit a signal corresponding to each of the detected movement positions to the image forming apparatus.

2. The toner refill cartridge of claim 1, wherein the signal corresponding to each of the detected movement positions indicates a degree of toner injection.

3. The toner refill cartridge of claim 1, wherein the toner injection amount detector comprises:

a plurality of switches connected to the connection interface; and a movable member which is movable in the longitudinal direction of the body by the plunger to change an electrical contact state of each of the plurality of switches.

4. The toner refill cartridge of claim 3, wherein the movable member is pushed by a pushing protrusion provided on the plunger from a time when the plunger reaches a certain position and sequentially opens the plurality of closed switches on a moving path of the movable member.

5. The toner refill cartridge of claim 3, wherein the movable member is pushed by a pushing protrusion provided on the plunger from a time when the plunger reaches a certain position and sequentially closes the plurality of open switches on a moving path of the movable member.

6. The toner refill cartridge of claim 3, wherein the movable member moves only in a direction in which the plunger pushes the toner out of the body.

7. The toner refill cartridge of claim 3, wherein locations at which the plurality of switches are opened and closed are equally spaced in the longitudinal direction of the body along a moving path of the movable member.

8. The toner refill cartridge of claim 1, wherein the toner injection amount detector comprises:

a variable resistance switch connected to the connection interface; and a movable member which is moved in the longitudinal direction of the body by the plunger to change a resistance value of the variable resistance switch.

9. The toner refill cartridge of claim 1, wherein the connection interface comprises:

an information manager to manage information indicating a degree of toner injection corresponding to each of the plurality of movement positions of the plunger; and an electrical contact portion to connect to the image forming apparatus.

10. The toner refill cartridge of claim 9, wherein the information manager is to store information indicating the degree of toner injection corresponding to a current movement position of the plunger when the toner refill cartridge is disconnected from the image forming apparatus.

11. The toner refill cartridge of claim 10, wherein the information manager is to, when the toner refill cartridge is connected to another image forming apparatus other than the image forming apparatus, transmit the stored information indicating the degree of toner injection corresponding to the current movement position of the plunger to the another image forming apparatus.

12. An image forming apparatus comprising:

a main body;

a developing cartridge to supply toner accommodated in a toner accommodating portion to an electrostatic latent image formed on a photoconductor to form a toner image, the developing cartridge being removable from the main body;

a toner refilling portion connected to the toner accommodating portion and on which a toner refill cartridge for refilling the toner accommodating portion with toner is mounted;

a processor to detect a signal corresponding to each of a plurality of movement positions of a plunger, detected in accordance with movement of the plunger of the toner refill cartridge mounted on the toner refilling portion and to determine a filling degree of toner based on the detected signal; and a user interface device to output information about the determined filling degree of toner.

13. The image forming apparatus of claim 12, wherein the processor is to determine the filling degree of toner based on a voltage level of the detected signal.

14. The image forming apparatus of claim 13, wherein the processor is to:

match a plurality of voltage levels with corresponding degrees of toner injection, and store the matched plurality of voltage levels and corresponding degrees of toner injection in advance, and determine the filling degree of toner by confirming a degree of toner injection matched to a voltage level of the detected signal.

15. The image forming apparatus of claim 12, wherein the processor is to receive information indicating a degree of toner injection corresponding to a current movement position of the plunger from the toner refill cartridge when the toner refill cartridge is connected to the image forming apparatus.

* * * * *